US011041309B2

(12) United States Patent
Imrich

(10) Patent No.: US 11,041,309 B2
(45) Date of Patent: Jun. 22, 2021

(54) NON-CORROSIVE MICRO REBAR

(71) Applicant: Steven T Imrich, Naples, FL (US)

(72) Inventor: Steven T Imrich, Naples, FL (US)

( * ) Notice: Subject to any disclaimer, the term of this patent is extended or adjusted under 35 U.S.C. 154(b) by 485 days.

(21) Appl. No.: 16/173,191

(22) Filed: Oct. 29, 2018

(65) Prior Publication Data

US 2020/0131768 A1 Apr. 30, 2020

(51) Int. Cl.
*E04C 5/01* (2006.01)
*E04C 5/07* (2006.01)

(52) U.S. Cl.
CPC ..... *E04C 5/015* (2013.01); *E04C 5/012* (2013.01); *E04C 5/073* (2013.01)

(58) Field of Classification Search
CPC . E04C 5/01; E04C 5/012; E04C 5/015; E04C 5/02; E04C 5/03; E04C 5/07; E04C 5/073; E04C 5/20
USPC ..... 52/851, 852, 853, 857
See application file for complete search history.

(56) References Cited

U.S. PATENT DOCUMENTS

D10,882 S * 10/1878 Mills ..... D1/125
884,341 A * 4/1908 Ramsey ..... E04C 5/03 52/857
911,062 A * 2/1909 McMullin ..... E04C 5/03 52/852
931,049 A * 8/1909 Foster et al. ..... E04C 5/03 52/857
931,320 A * 8/1909 Large ..... E04C 5/03 52/857
1,317,824 A * 10/1919 Royse ..... E04C 5/03 52/853
2,260,779 A * 10/1941 Hoffmann ..... B21D 11/15 72/187
4,050,949 A * 9/1977 Lundgren ..... C04B 14/34 106/643
4,119,764 A * 10/1978 Mizuma ..... B21F 27/20 428/592
4,137,686 A * 2/1979 Kern ..... E04C 5/03 52/851
4,791,772 A * 12/1988 Potucek ..... E04C 5/03 403/314
5,314,268 A * 5/1994 Calandra, Jr. ..... E21D 21/0006 405/259.5
5,449,563 A * 9/1995 Zhang ..... C23F 13/10 228/262.44
5,650,109 A * 7/1997 Kaiser ..... B29C 70/081 264/136

(Continued)

*Primary Examiner* — James M Ference

(57) ABSTRACT

The non-corrosive micro rebar is an apparatus that reinforces concrete structures. The apparatus includes a central rod, a plurality of threads, and a plurality of channels. The central rod connects the plurality of threads to one another and allows the apparatus to be flexible within the concrete structure. The plurality of threads allows a concrete mixture to grip around the apparatus. The concrete mixture surrounds the apparatus by filling the plurality of channels. In order for apparatus to hold together the concrete structure, each of the plurality of threads includes a connecting rod and an anchoring bar. The plurality of threads laterally traverses along the central rod and is radially distributed about the central rod. The connecting bar is fixed to the central rod and is oriented perpendicular to the central rod. The connecting bar traverse across the connecting rod and is oriented concave with the connecting rod.

16 Claims, 7 Drawing Sheets

(56) References Cited

U.S. PATENT DOCUMENTS 5,950,393 A * 9/1999 Stecker ..... E04C 5/07 52/836
6,060,163 A * 5/2000 Naaman ..... E04C 5/03 428/397
D427,669 S * 7/2000 Ruuska ..... D23/266
6,264,403 B1 * 7/2001 Hall ..... E02D 5/54 405/231
6,286,270 B1 * 9/2001 Gruson ..... E04C 5/03 52/155
D478,705 S * 8/2003 Dahl ..... A23K 40/20 D1/125
D531,650 S * 11/2006 Switzer ..... D15/139
D559,874 S * 1/2008 Kobayashi ..... D15/139
D636,971 S * 5/2011 Diermeier ..... D1/125
D648,917 S * 11/2011 Farkas ..... D1/125
D678,369 S * 3/2013 Santamarina ..... D15/139
8,915,046 B2 * 12/2014 Wright, III ..... B29D 99/0003 52/857
8,916,223 B2 * 12/2014 Burgess ..... A23G 3/2015 426/516
D721,217 S * 1/2015 Rogers ..... D1/125
D734,792 S * 7/2015 Santamarina ..... D15/139
D737,875 S * 9/2015 Santamarina ..... D15/139
9,217,288 B1 * 12/2015 Fiorello ..... B23B 41/00
D747,068 S * 1/2016 Walsh ..... D1/125
9,243,406 B1 * 1/2016 Boguslavschi ..... E04C 5/03
9,440,881 B2 * 9/2016 Pinkerton ..... G01B 5/30
D785,901 S * 5/2017 Wilson ..... D1/125
D793,650 S * 8/2017 Herrenbruck ..... D1/125
D812,751 S * 3/2018 Richter ..... D24/146
D876,929 S * 3/2020 Imrich ..... D8/354
2004/0035177 A1 * 2/2004 Ollis ..... E04B 1/7629 72/371
2004/0065044 A1 * 4/2004 Bleibler ..... B29C 70/50 52/649.1
2008/0127599 A1 * 6/2008 Chen ..... E04C 5/07 52/854
2008/0302063 A1 * 12/2008 Braasch ..... E04C 5/07 52/853
2011/0098755 A1 * 4/2011 Jackson ..... A61B 17/8685 606/305
2012/0066994 A1 * 3/2012 Gibson ..... B29C 70/527 52/309.13
2012/0180426 A1 * 7/2012 Bromer ..... E04C 5/08 52/831
2013/0209192 A1 * 8/2013 Wood ..... E21D 21/008 411/82
2014/0341649 A1 * 11/2014 Bryan ..... F16B 37/145 404/35
2015/0218814 A1 * 8/2015 Edoo ..... E04C 5/07 428/36.91
2017/0145824 A1 * 5/2017 Tu ..... E04C 5/03
2020/0131768 A1 * 4/2020 Imrich ..... E04C 5/073

* cited by examiner

NON-CORROSIVE MICRO REBAR

FIELD OF THE INVENTION

The present invention generally relates to micro rebar. More specifically, the present invention is a non-corrosive micro rebar.

BACKGROUND OF THE INVENTION

Concrete mixtures are used to for a variety of structures that endure plenty of wear and tear. Such structures include, roads, sidewalks, divider walls, roof structures, homes, buildings, support columns submerged in water, and so on. In order to reinforce concrete mixtures, rebar is used to accommodate for any imbalances in concrete. More commonly used is micro rebar, which accommodates a wider range of shapes and sizes of concrete structures. Moreover, micro rebar accounts for more volume of concrete within a specific area of the concrete structure and more easily incorporated into concrete mixture than rebar itself. Micro rebar reduces the labor cost as well.

It is therefore an objective of the present invention to improve upon the structural reinforcement of micro rebar within concrete structures. The present invention not only accounts for the imbalances in concrete and accommodate any force or stress imposed upon the concrete structures, the present invention comprises improved threads that allows the concrete mixture to remain intact while supporting heavy loads, absorbing direct contact and force, withstanding harsh weather environments, and so on. Furthermore, the present invention is preferably made of plastic in order to lessen the weight of the of the present invention and the overall weight of the concrete structure. The plastic material also eliminates issues of corrosion in wet or harsh chemical environments. The present invention is able to hold together concrete structures, despite being made of plastic, as the present invention comprises a plurality of structurally sound threads.

DETAIL DESCRIPTIONS OF THE INVENTION

All illustrations of the drawings are for the purpose of describing selected versions of the present invention and are not intended to limit the scope of the present invention.

Figure 1:
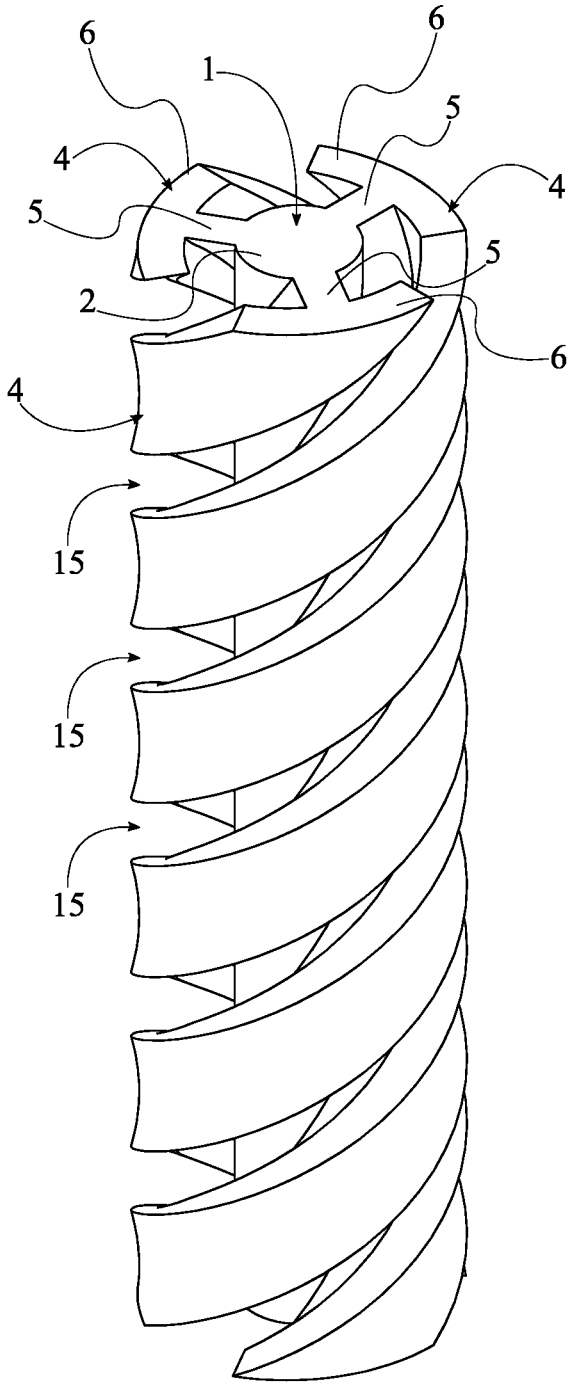
FIG. 1 is a top perspective view of a first embodiment of the present invention.
Figure 2:
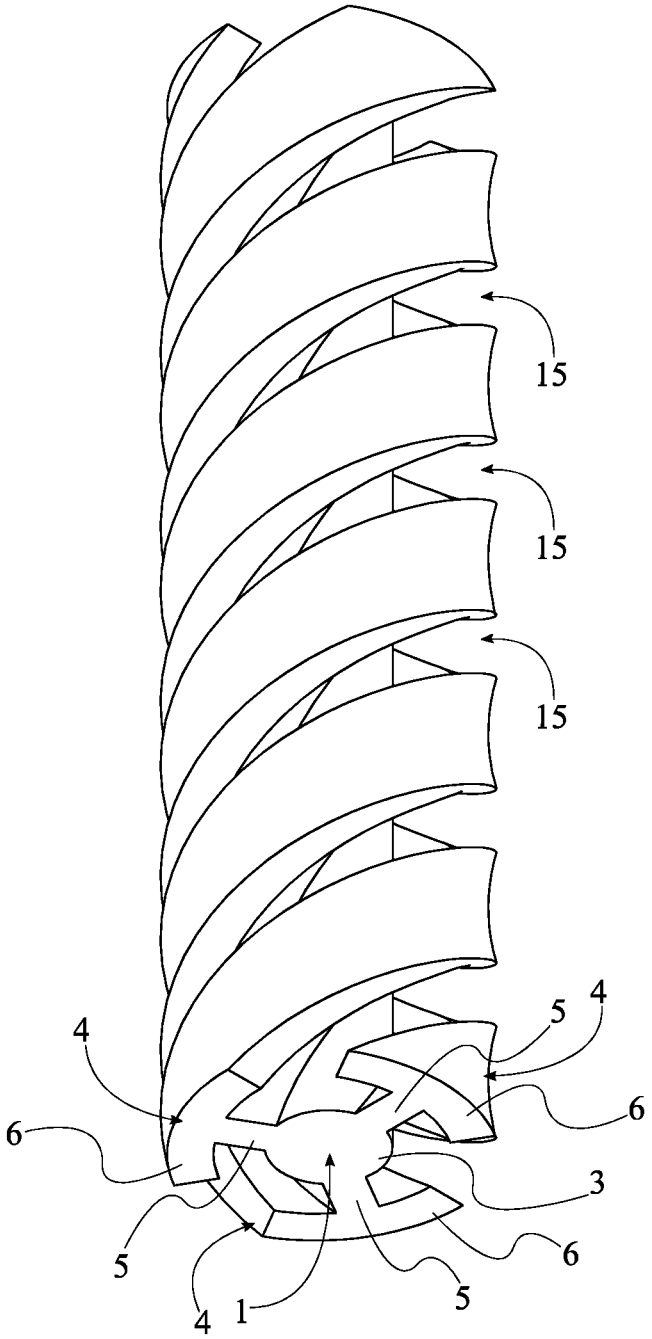
FIG. 2 is a bottom perspective view of the first embodiment of the present invention.

The present invention is a non-corrosive micro rebar that effectively reinforces concrete structures. The present invention not only enhances the structural integrity of concrete structures but preserves the concrete structures for a longer period of time as the present invention preferably comprises plastic materials. In order for the present invention to reinforce concrete structures, the present invention comprises a central rod 1, a plurality of threads 4, and a plurality of channels 15, as seen in FIG. 1 and FIG. 2. The central rod 1 positions and connects the plurality of threads 4 to one another. The plurality of threads 4 allows a concrete mixture to securely grip and surround the present invention. The central rod 1 and the plurality of threads 4 allows the concrete structure to better respond to high-force impact whether the high-force impact is a result of direct contact, an earthquake, a hurricane, and so on. The plurality of channels 15 allows the concrete mixture to surround each of the plurality of threads 4 and the central rod 1. Furthermore, the plurality of channels 15 is defined by the plurality of threads 4. Each of the plurality of threads 4 comprises a connecting rod 5 and an anchoring bar 6. The connecting rod 5 offsets the anchoring bar 6 from the central rod 1. The anchoring bar 6 allows the concrete mixture to securely solidify around and grasp onto each thread 4 and, consequently the central rod 1.

The overall configuration of the aforementioned components allows a concrete structure to be effectively reinforced by the present invention. The plurality of threads 4 laterally traverses along the central rod 1, seen in FIG. 4 and FIG. 5, and is radially distributed around the central rod 1, seen in FIG. 3 and FIG. 6, thereby reducing the stress on both the central rod 1 and the plurality of threads 4. More specifically, the plurality of threads 4 is equally distributed around the central rod 1. In order for a concrete mixture to surround the plurality of threads 4 and the central rod 1, each channel of the plurality of channels 15 is positioned in between a thread 4 and an adjacent thread 4 of the plurality of threads 4. Moreover, each channel of the plurality of channels 15 is offset from each other by a thread of the plurality of threads 4 such that limited stress is imposed upon each thread. In order for each thread 4 to be structurally sound within the concrete mixture, the connecting rod 5 is fixed to the central rod 1 and is oriented perpendicular to the central rod 1. The anchoring bar 6 is positioned adjacent the connecting rod 5, opposite the central rod 1 so that each thread 4 is properly anchored within the concrete structure. In order to preserve the structural integrity of the central rod 1, the anchoring bar 6 traverses across the connecting rod 5. Each thread 4 is structurally sound within the concrete structure as the anchoring bar 6 is oriented concave with the connecting rod 5 and is centrally aligned with the connecting rod 5.

Figure 3:
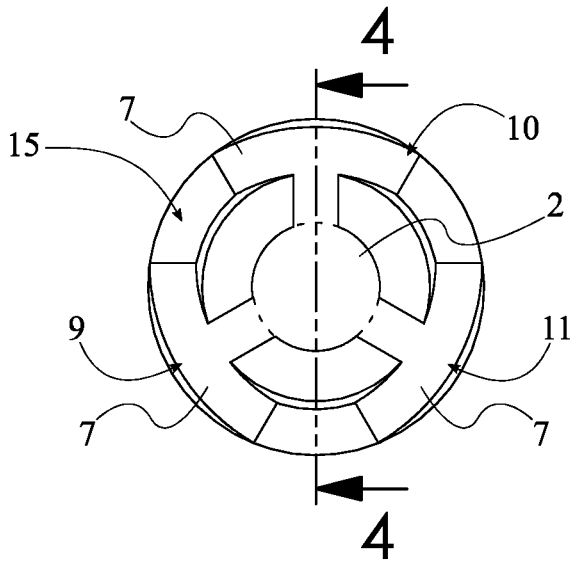
FIG. 3 is a top side view of the first embodiment of the present invention.
Figure 4:
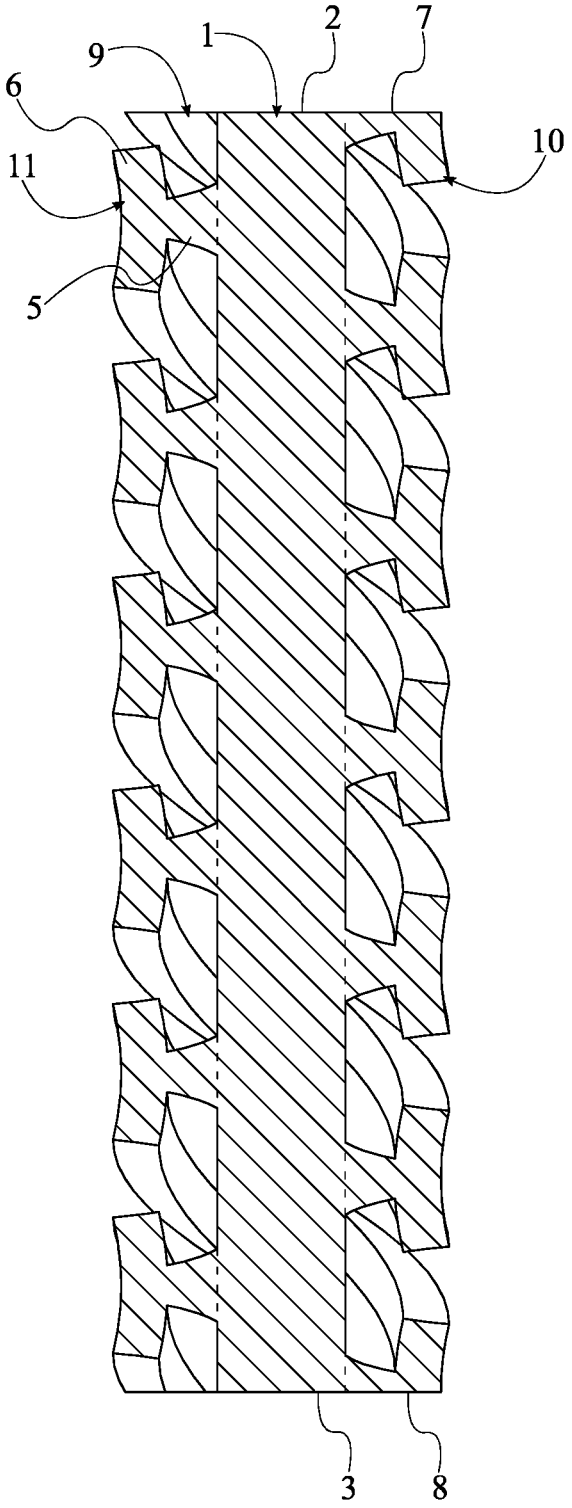
FIG. 4 is a cross-section view of FIG. 3 along line 4-4 of the present invention.
Figure 5:
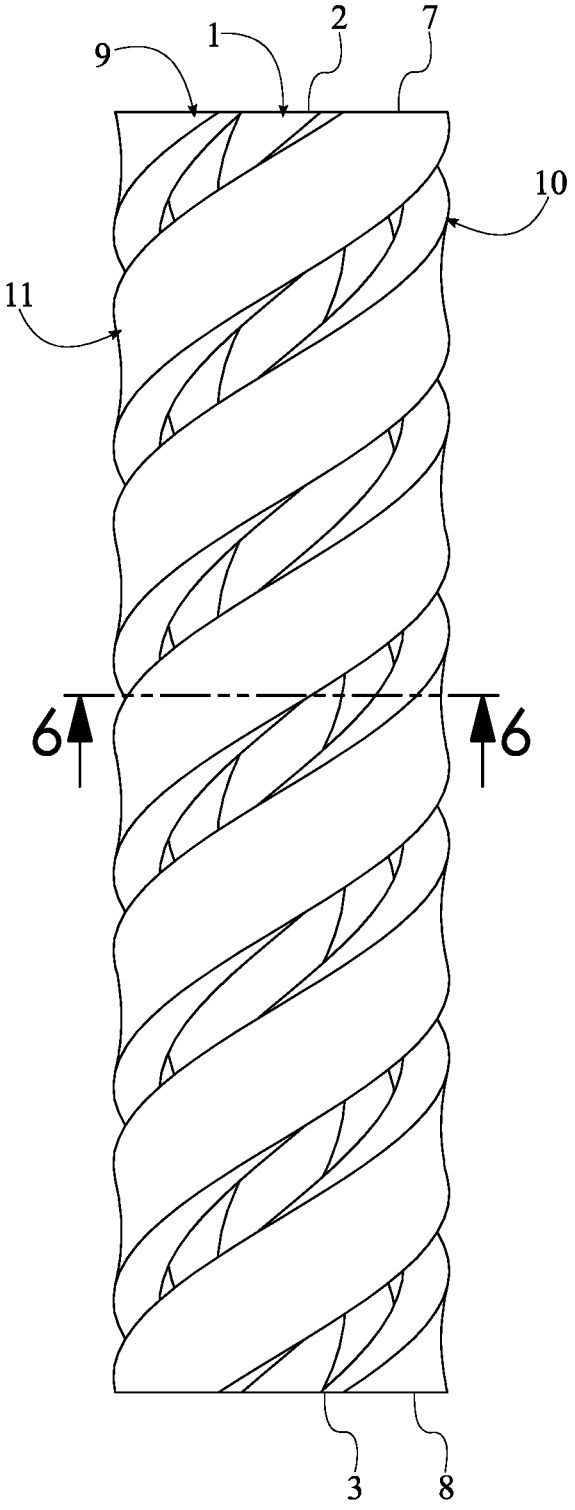
FIG. 5 is a front side view of the first embodiment of the present invention.

In the preferred embodiment of the present invention, the central rod 1 comprises a first flat surface 2 and a second flat surface 3, shown in FIG. 1, FIG. 2, FIG. 3. FIG. 4, and FIG. 5. Each of the plurality of threads 4 further comprise a first flat surface 7 and a second flat surface 8. The first flat surface 2 and the second flat surface 3 of the central rod 1, as well as the first flat surface 7 and the second flat surface 8 of each thread 4, allows a concrete mixture to grasp onto the present invention. The first flat surface 2 of the central rod 1 is positioned opposite the second flat surface 3 of the central rod 1, across the central rod 1. The first flat surface 7 of each thread 4 is positioned adjacent the first flat surface 2 of the central rod 1. Similarly, the second flat surface 8 of each thread 4 is positioned adjacent the second flat surface 3 of the central rod 1. More specifically, the first flat surface 2 of the central rod 1 is coplanar with the first flat surface 7 of each thread 4, and the second flat surface 3 of the central rod 1 is coplanar with the second flat surface 8 of each thread 4. This arrangement reduces the amount of stress on the central rod 1 from the surrounding concrete structure.

Figure 6:
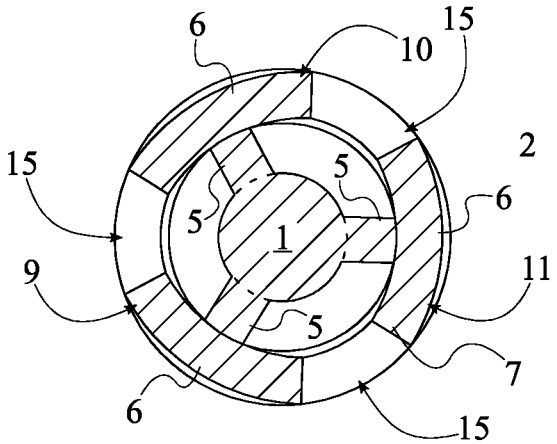
FIG. 6 is a cross-section view of FIG. 5 along line 6-6 of the present invention.

In a first embodiment of the present invention, seen in FIG. 3 and FIG. 6, the plurality of threads 4 comprises a first thread 9, a second thread 10, and a third thread 11. The first thread 9, the second thread 10, and the third thread 11, together, effectively holds together and reinforces the concrete structure, while allowing for more mobility of connecting rod 5. The second thread 10 is positioned in between the first thread 9 and the third thread 11. Moreover, the first thread 9, the second thread 10, and the third thread 11 are equally distributed about the central rod 1. The central rod 1 of first thread 9, the central rod 1 of the second thread 10, and the central rod 1 of the third thread 11 are 120 degrees apart from each other.

Figure 7:
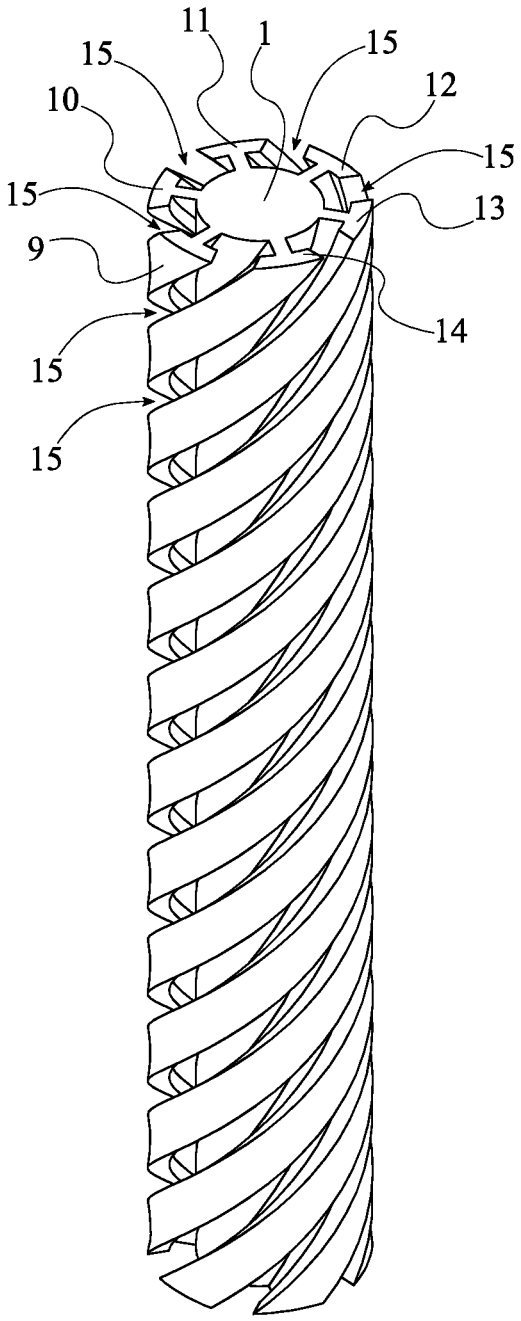
FIG. 7 is a top perspective view of a second embodiment of the present invention.

In a second embodiment of the present invention, the plurality of threads 4 comprises a first thread 9, a second thread 10, a third thread 11, a fourth thread 12, a fifth thread 13, and a sixth thread 14, seen in FIG. 7. The first thread 9, the second thread 10, the third thread 11, the fourth thread 12, the fifth thread 13, and the sixth thread 14, together, effectively holds together and reinforces the concrete structure. Unlike the first embodiment of the present invention, the second embodiment of the present invention comprises a more rigid construction as a result. Consequently, the concrete structure imbedded with the second embodiment of the present invention is more rigid as well. Similar to the first embodiment of the second thread 10 is positioned in between the first thread 9 and the third thread 11. The fourth thread 12 is positioned adjacent the third thread 11, opposite the second thread 10. The fifth thread 13 is positioned adjacent the fourth thread 12, opposite the third thread 11. The sixth thread 14 is positioned adjacent the fifth thread 13, opposite the fourth thread 12. The first thread 9 is positioned adjacent the sixth thread 14, opposite the fifth thread 13. Similar to the first embodiment of the present invention, the first thread 9, the second thread 10, the third thread 11, the fourth thread 12, the fifth thread 13, and the sixth thread 14 are equally distributed about the central rod 1. The central rod 1 of first thread 9, the central rod 1 of the second thread 10, the central rod 1 of the third thread 11, the central rod 1 of the fourth thread 12, the central rod 1 of the fifth thread 13, and the central rod 1 of the sixth rod are 60 degrees apart from each other.

It is understood that various embodiments of the present invention may comprise varying amounts of threads that are equally distributed about the central rod 1. More specifically, the degrees between the central rod 1 a thread 4 and a central rod 1 of an adjacent thread may vary in each embodiment.

In the preferred embodiment of the present invention, seen in FIG. 4 and FIG. 5, each thread 4 comprises a pitch-to-revolution ratio of 1:1 along the connecting rod 5, wherein the pitch is one inch. This ratio maximizes the strength of the present invention. The overall length of the connecting rod 5 is approximately 1-3 inches, and the width is approximately ¼ an inch. Various embodiments of the present invention may comprise varying lengths and widths. Furthermore, in the preferred embodiment of the present invention, the central rod 1 and the plurality of threads 4 are made of plastic. The plastic material preserves the present invention in wet environments and under harsh chemical exposures. Moreover, the plastic material is lightweight, reducing the overall weight of the concrete structure. The strength does not lessen over time as a result of rusting like that of metal-like materials.

In order to effectively reinforce concrete structures with the present invention, the method begins with by providing a quantity of concrete mixture. As the concrete mixture is being mixed, in order to preserve the consistency of the mixture, a plurality of the present invention is poured into the concrete mixture. The concrete mixture and the present invention are thoroughly mixed until a combination of the concrete mixture and the present invention is ready to be poured into a mold. The mold may include, but is not limited to, wall molds, pavement, and so on. The combination is poured and dried as that of typical concrete mixtures. In the preferred embodiment of the present invention, recycled plastic is used construct the central rod 1 and the plurality of threads 4.

Although the invention has been explained in relation to its preferred embodiment, it is to be understood that many other possible modifications and variations can be made without departing from the spirit and scope of the invention as hereinafter claimed.

What is claimed is:

1. A non-corrosive micro rebar comprising:

a central rod;

a plurality of threads;

a plurality of channels;

each of the plurality of threads comprising a connecting rod and an anchoring bar;

the plurality of threads laterally traversing along the central rod;

the plurality of threads being radially distributed around the central rod;

the plurality of threads being equally distributed about the central rod;

each channel of the plurality of channels being positioned in between a thread and an adjacent thread of the plurality of threads;

each channel of the plurality of channels being offset from each other by a thread of the plurality of threads the connecting rod being fixed to the central rod;

the connecting rod being oriented perpendicular to the central rod;

the anchoring bar being positioned adjacent the connecting rod, opposite the central rod;

the anchoring bar traversing across the connecting rod;

the anchoring bar being oriented concave with the connecting rod; and, the anchoring bar being centrally aligned with the connecting rod.

2. The non-corrosive micro rebar as claimed in claim 1 wherein:

the central rod comprises a first flat surface and a second flat surface;

each of the plurality of threads comprises a first flat surface and a second flat surface;

the first flat surface of the central rod being positioned opposite the second flat surface of the central rod, across the central rod;

the first flat surface of each thread of the plurality of threads being positioned adjacent the first flat surface of the central rod;

the second flat surface of each thread of the plurality of threads being positioned adjacent the second flat surface of the central rod;

the first flat surface of the central rod being coplanar with the first flat surface of each thread of the plurality of threads; and, the second flat surface of the central rod being coplanar with the second flat surface of each thread of the plurality of threads.

3. The non-corrosive micro rebar as claimed in claim 1 wherein:

the plurality of threads comprises a first thread, a second thread, and a third thread;

the second thread being positioned in between the first thread and the third thread; and, the first thread, the second thread, and the third thread being equally distributed about the central rod.

4. The non-corrosive micro rebar as claimed in claim 1 wherein:

the plurality of threads comprises a first thread, a second thread, a third thread, a fourth thread, a fifth thread, and a sixth thread;

the second thread being positioned in between the first thread and the third thread;

the fourth thread being positioned adjacent the third thread, opposite the second thread;

the fifth thread being positioned adjacent the fourth thread, opposite the third thread;

the sixth thread being positioned adjacent the fifth thread, opposite the fourth thread;

the first thread being positioned adjacent the sixth thread, opposite the fifth thread; and, the first thread, the second thread, the third thread, the fourth thread, the fifth thread, and the sixth thread being equally distributed about the central rod.

5. The non-corrosive micro rebar as claimed in claim 1 wherein:

each thread of the plurality of threads comprises a pitch-to-revolution ratio of 1:1 along the connecting rod, wherein the pitch is one inch.

6. The non-corrosive micro rebar as claimed in claim 1 wherein the central rod and the plurality of threads are made of plastic.

7. A non-corrosive micro rebar comprising:

a central rod;

a plurality of threads;

a plurality of channels;

each of the plurality of threads comprising a connecting rod and an anchoring bar;

the plurality of threads laterally traversing along the central rod;

the plurality of threads being radially distributed around the central rod;

the plurality of threads being equally distributed about the central rod;

each channel of the plurality of channels being positioned in between a thread and an adjacent thread of the plurality of threads;

each channel of the plurality of channels being offset from each other by a thread of the plurality of threads the connecting rod being fixed to the central rod;

the connecting rod being oriented perpendicular to the central rod;

the anchoring bar being positioned adjacent the connecting rod, opposite the central rod;

the anchoring bar traversing across the connecting rod;

the anchoring bar being oriented concave with the connecting rod;

the anchoring bar being centrally aligned with the connecting rod; and, each thread of the plurality of threads comprising a pitch-to-revolution ratio of 1:1 along the connecting rod, wherein the pitch is one inch.

8. The non-corrosive micro rebar as claimed in claim 7 wherein:

the central rod comprises a first flat surface and a second flat surface;

each of the plurality of threads comprises a first flat surface and a second flat surface;

the first flat surface of the central rod being positioned opposite the second flat surface of the central rod, across the central rod;

the first flat surface of each thread of the plurality of threads being positioned adjacent the first flat surface of the central rod;

the second flat surface of each thread of the plurality of threads being positioned adjacent the second flat surface of the central rod;

the first flat surface of the central rod being coplanar with the first flat surface of each thread of the plurality of threads; and, the second flat surface of the central rod being coplanar with the second flat surface of each thread of the plurality of threads.

9. The non-corrosive micro rebar as claimed in claim 7 wherein:

the plurality of threads comprises a first thread, a second thread, and a third thread;

the second thread being positioned in between the first thread and the third thread; and, the first thread, the second thread, and the third thread being equally distributed about the central rod.

10. The non-corrosive micro rebar as claimed in claim 7 wherein:

the plurality of threads comprises a first thread, a second thread, a third thread, a fourth thread, a fifth thread, and a sixth thread;

the second thread being positioned in between the first thread and the third thread;

the fourth thread being positioned adjacent the third thread, opposite the second thread;

the fifth thread being positioned adjacent the fourth thread, opposite the third thread;

the sixth thread being positioned adjacent the fifth thread, opposite the fourth thread;

the first thread being positioned adjacent the sixth thread, opposite the fifth thread; and, the first thread, the second thread, the third thread, the fourth thread, the fifth thread, and the sixth thread being equally distributed about the central rod.

11. The non-corrosive micro rebar as claimed in claim 7 wherein the central rod and the plurality of threads are made of plastic.

12. A non-corrosive micro rebar comprising:

a central rod;

a plurality of threads;

a plurality of channels;

each of the plurality of threads comprising a connecting rod, an anchoring bar, a first flat surface, and a second flat surface; the central rod comprises a first flat surface and a second flat surface;

the plurality of threads laterally traversing along the central rod;

the plurality of threads being radially distributed around the central rod;

the plurality of threads being equally distributed about the central rod;

each channel of the plurality of channels being positioned in between a thread and an adjacent thread of the plurality of threads;

each channel of the plurality of channels being offset from each other by a thread of the plurality of threads the connecting rod being fixed to the central rod;

the connecting rod being oriented perpendicular to the central rod;

the anchoring bar being positioned adjacent the connecting rod, opposite the central rod;

the anchoring bar traversing across the connecting rod;

the anchoring bar being oriented concave with the connecting rod;

the anchoring bar being centrally aligned with the connecting rod;

the first flat surface of the central rod being positioned opposite the second flat surface of the central rod, across the central rod;

the first flat surface of each thread of the plurality of threads being positioned adjacent the first flat surface of the central rod;

the second flat surface of each thread of the plurality of threads being positioned adjacent the second flat surface of the central rod;

the first flat surface of the central rod being coplanar with the first flat surface of each thread of the plurality of threads; and, the second flat surface of the central rod being coplanar with the second flat surface of each thread of the plurality of threads.

13. The non-corrosive micro rebar as claimed in claim 12 wherein:

the plurality of threads comprises a first thread, a second thread, and a third thread;

the second thread being positioned in between the first thread and the third thread; and, the first thread, the second thread, and the third thread being equally distributed about the central rod.

14. The non-corrosive micro rebar as claimed in claim 12 wherein:

the plurality of threads comprises a first thread, a second thread, a third thread, a fourth thread, a fifth thread, and a sixth thread;

the second thread being positioned in between the first thread and the third thread;

the fourth thread being positioned adjacent the third thread, opposite the second thread;

the fifth thread being positioned adjacent the fourth thread, opposite the third thread;

the sixth thread being positioned adjacent the fifth thread, opposite the fourth thread;

the first thread being positioned adjacent the sixth thread, opposite the fifth thread; and, the first thread, the second thread, the third thread, the fourth thread, the fifth thread, and the sixth thread being equally distributed about the central rod.

15. The non-corrosive micro rebar as claimed in claim 12 wherein:

each thread of the plurality of threads comprises a pitch-to-revolution ratio of 1:1 along the connecting rod, wherein the pitch is one inch.

16. The non-corrosive micro rebar as claimed in claim 12 wherein the central rod and the plurality of threads are made of plastic.

* * * * *